US010640918B2

(12) United States Patent
Freeman et al.

(10) Patent No.: US 10,640,918 B2
(45) Date of Patent: May 5, 2020

(54) FUNCTIONALIZED FIBROUS MATERIAL

(71) Applicants: HBI Branded Apparel Enterprises, LLC, Winston Salem, NC (US); Cotton Incorporated, Cary, NC (US); North Carolina State University, Raleigh, NC (US)

(72) Inventors: Harold S. Freeman, Raleigh, NC (US); Malgorzata Szymczyk, Raleigh, NC (US); Keith Zimmerman, Durham, NC (US); Matthew J. Farrell, Cary, NC (US)

(73) Assignees: HBI Branded Apparel Enterprises, LLC, Winston Salem, NC (US); Cotton Incorporated, Cary, NC (US); North Carolina State University, Raleigh, NC (US)

( * ) Notice: Subject to any disclaimer, the term of this patent is extended or adjusted under 35 U.S.C. 154(b) by 0 days.

(21) Appl. No.: 15/998,782

(22) Filed: Aug. 15, 2018

(65) Prior Publication Data

US 2019/0055692 A1 Feb. 21, 2019

Related U.S. Application Data

(60) Provisional application No. 62/545,616, filed on Aug. 15, 2017.

(51) Int. Cl.
*D06P 5/00* (2006.01)
*D06P 5/22* (2006.01)
(Continued)

(52) U.S. Cl.
CPC ..... *D06P 5/225* (2013.01); *D06M 13/463* (2013.01); *D06P 1/38* (2013.01); *D06P 1/66* (2013.01);
(Continued)

(58) Field of Classification Search
CPC .. D06P 5/225; D06P 1/66; D06P 3/60; D06M 13/463; D06M 2101/06; D06M 13/46; D06M 13/322
See application file for complete search history.

(56) References Cited

U.S. PATENT DOCUMENTS 3,778,225 A 12/1973 Cuvelier
3,834,867 A 9/1974 Matter
(Continued)

FOREIGN PATENT DOCUMENTS

CN 101403185 4/2009
CN 101812226 8/2010
(Continued)

OTHER PUBLICATIONS

STIC Search Report dated Aug. 9, 2019.*
(Continued)

*Primary Examiner* — Eisa B Elhilo
(74) *Attorney, Agent, or Firm* — Fish & Richardson P.C.

(57) ABSTRACT

Functionalizing a fibrous material having a plurality of hydroxyl groups includes reacting the fibrous material with a compound of Formula I:

(I)

where X is a monovalent counteranion for the quaternary ammonium cation of Formula I and Hal is a halogen atom,
(Continued)

to obtain the functionalized fibrous material. Also provided is a functionalized fibrous material prepared by any one of the methods described herein (e.g., a functionalized fiber including a moiety of Formula II:

( e.g., a functionalized fiber including a moiety of Formula II:

(II)

having an odor of free amine below the threshold of detection, or having an odor of free amine with degree of offensiveness of about 3 or less. The functionalized fibrous material may be dyed, and articles of clothing may be made from the dyed functionalized fibrous material.

20 Claims, 3 Drawing Sheets

(51) Int. Cl.

| | |
|---|---|
| ***D06P 1/66*** | (2006.01) |
| ***D06P 1/38*** | (2006.01) |
| ***D06M 13/463*** | (2006.01) |
| ***D06P 3/60*** | (2006.01) |
| *D06M 101/06* | (2006.01) |

(52) U.S. Cl.
CPC ..... *D06P 3/60* (2013.01); *D06M 2101/06* (2013.01); *D06M 2400/01* (2013.01)

(56) References Cited

U.S. PATENT DOCUMENTS

| | | | | |
|---|---|---|---|---|
| 4,331,441 | A | 5/1982 | Dvorsky | |
| 4,369,041 | A | 1/1983 | Dvorsky | |
| 5,243,072 | A | 9/1993 | Gruning | |
| 5,409,705 | A | 4/1995 | Kita | |
| 6,117,191 | A | 9/2000 | McNamee | |
| 6,541,614 | B1 | 4/2003 | Nagasawa | |
| 7,201,778 | B2 * | 4/2007 | Smith | D06M 15/03 252/8.91 |
| 8,217,201 | B2 | 7/2012 | Deavenport | |
| 2015/0210627 | A1 | 7/2015 | Deavenport et al. | |

FOREIGN PATENT DOCUMENTS

| | | |
|---|---|---|
| CN | 102226080 | 10/2011 |
| CN | 102642905 | 8/2012 |
| CN | 103952909 | 7/2014 |
| CS | 205608 | 5/1981 |
| CS | 211444 | 2/1982 |
| WO | 1997045395 | 12/1997 |

OTHER PUBLICATIONS

International Search Report and Written Opinion in International Application No. PCT/US2018/046765, dated Nov. 14, 2018, 12 pages.

Choudhury et al., "Coloration of Cationized Cellulosic Fibers—A Review", AATCC Journal of Research, May/Jun. 2014, 1(3):11-19.

Iowa State, "The Science of Smell Part 3: Odor Detection and Measurement", Oct. 2004, 4 pages.

ISO 13301:2002, "Sensory Analysis—Methodology—General guidance for measuring odour, flavour and taste detection thresholds by a three-alternative forced-choice (3-AFC) procedure", Sep. 2002, 7 pages.

Lovett et al., "Intramolecular Cyclization Products from Alkanolamines and Epichlorohydrin", Journal of Organic Chemistry, 1987, 52(23):5247-5254.

Sharif et al., "Synthesis and Spectroscopic Characterisation of 2,3-Epoxy/3-Chloro-2-hydroxy Propyl Derivatives of Quaternary Ammonium Salts: Useful Cationic Fixing Agents", Chinese Journal of Chemistry, 2008, 26:553-559.

Wise et al., "Human Odor Detection of Homologous Carboxylic Acids and Their Binary Mixtures", Chemical Senses, 2007, 32:475-482.

* cited by examiner

FUNCTIONALIZED FIBROUS MATERIAL

CROSS-REFERENCE TO RELATED APPLICATION

This application claims the benefit of U.S. Application No. 62/545,616 entitled "FUNCTIONALIZED FIBROUS MATERIAL" and filed on Aug. 15, 2017, which is incorporated by reference herein in its entirety.

TECHNICAL FIELD

This invention relates to cationized fibrous material, and particularly to fibrous material containing cationized cellulosic fiber.

BACKGROUND

Dyeing fabric containing cellulosic fibers is an important chemical industrial process that results in multiple commercial textile products. Dyeing is the most costly step in the textile processing. A typical dyeing protocol involves the use of high amount of water and energy and generates significant amount of chemical waste. Further, when contacted with water, cellulosic fibers generate slightly negative charges due to ionization of the hydroxyl groups. This reduces the efficiency of dyeing cellulosic fibers due to the fact that many dye molecules (including the reactive dyes) contain a negatively charged anionic group (e.g., $CO_2H$ or $SO_2H$). To overcome this, in a conventional dyeing process, a large amount of electrolytes, such as Glauber's salt, is used to neutralize the repulsive forces between negative charges of the dye and negative charges produced on the fiber surface. When Glauber's salt is used, approximately 60% of the dye is exhausted in conventional dyeing systems. The electrolyte remaining in the dyebath after dyeing pollutes the environment via the discharge of a highly colored and saline dyebath. Further, the abundant hydroxyl ions typically cause significant hydrolysis of the reactive dyes.

SUMMARY

In a first general aspect, functionalizing a fibrous material having a plurality of hydroxyl groups includes reacting the fibrous material with a compound of Formula I to obtain a functionalized fibrous material:

(I)

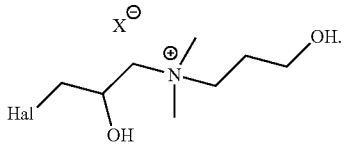

In Formula I, X is a monovalent counteranion for the quaternary ammonium cation and Hal is a halogen atom.

Implementations of the first general aspect may include one or more of the following features.

Hal may be Cl or Br, and X may be Cl or Br. The fibrous material may include cellulosic fibrous material. In some cases, the cellulosic fibrous material includes a natural fibrous material, such cotton. In certain causes, the cellulosic fibrous material is a synthetic fibrous material, such as rayon.

The reaction may be carried out in an aqueous solvent, such as water. In some aspects, the reaction yields a covalent bond between the carbon atom to which Hal is bonded and the oxygen atom of a hydroxyl group of the fibrous material. The functionalized fibrous material may include at least one moiety of Formula II.

(II)

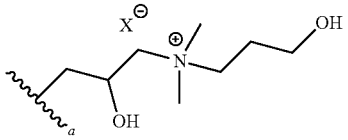

In Formula II, a denotes a point of attachment to the oxygen atom of a hydroxyl group of the fibrous material.

The reaction may be carried out in the presence of a base. In some cases, the ratio of the base to the compound of Formula I is from about 1:1 to about 2:1. The base may be an alkali hydroxide, such as sodium hydroxide. The reaction may be carried out at about room temperature.

A second general aspect includes a functionalized fibrous material prepared by any one of the processes of the first general aspect.

In a third general aspect, a fibrous material has a plurality of hydroxyl groups, wherein at least one hydroxyl group of the fibrous material is functionalized with a moiety of Formula II.

(II)

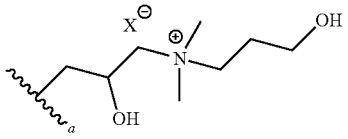

In Formula II, X is a monovalent counteranion for the quaternary ammonium cation of Formula I, and a denotes a point of attachment of the moiety of Formula II to the oxygen atom of the hydroxyl group of the fibrous material.

Implementations of the third general aspect may include one or more of the following features.

X may be Cl or Br. The fibrous material may include cellulosic fibrous material. In some cases, the cellulosic fibrous material includes a natural fibrous material, such as cotton. In certain cases, the cellulosic fibrous material is a synthetic fibrous material, such as rayon.

The fibrous material may have an odor below the threshold of detection, or an odor with degree of offensiveness of about 3 or less.

In a fourth general aspect, dyeing a fibrous material includes contacting the fibrous material with a dye.

Implementations of the fourth general aspect may include one or more of the following features.

In some cases, the dye is a reactive dye. In certain cases, the dye is an acid dye.

Methods and materials are described herein for use in the present application; other suitable methods and materials known in the art can also be used. The materials, methods, and examples are illustrative only and not intended to be limiting. All publications, patent applications, patents, and other references mentioned herein are incorporated by reference in their entirety. In case of conflict, the present specification, including definitions, will control.

Other features and advantages of the present application will be apparent from the following detailed description and figures, and from the claims.

DETAILED DESCRIPTION

Figure 1:
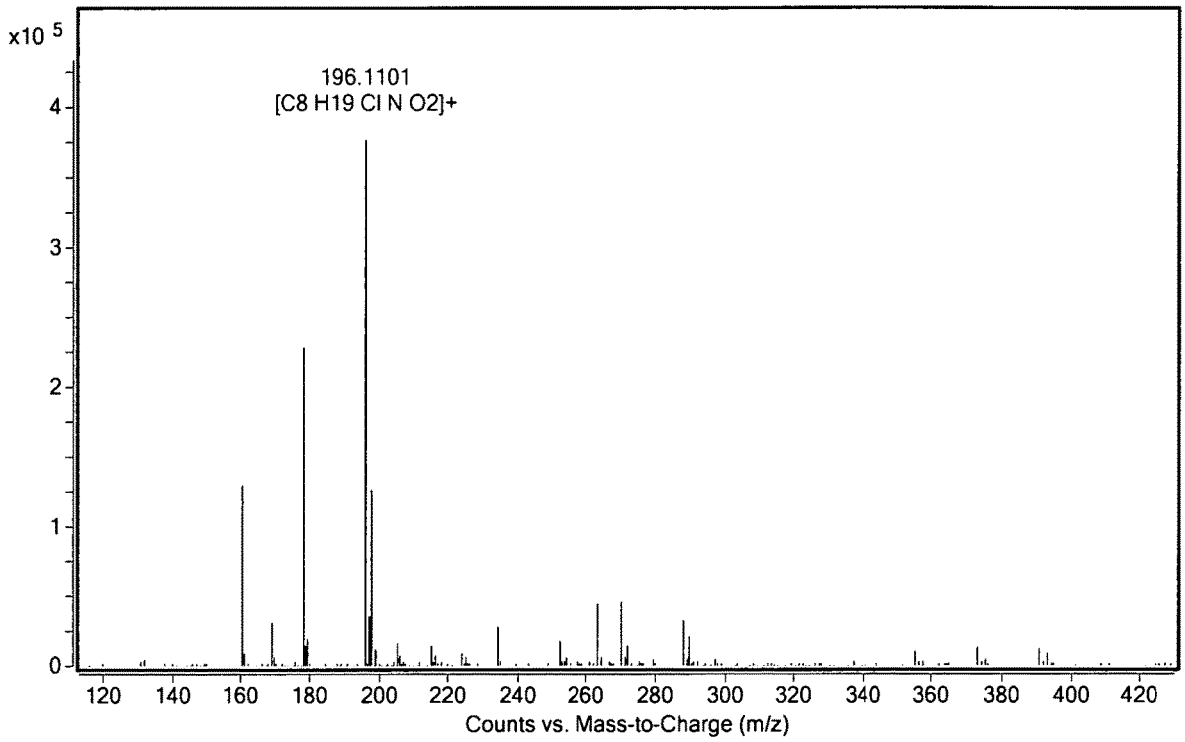
FIG. 1 is a plot showing a positive ion electrospray ionization mass spectrometry (ESI MS) spectrum of N-glycidyl 3-(dimethylamino)propan-1-ol (glycidoxyDMAP).

Cationizing fibrous material, such as cotton fiber, increases dye fixation due at least in part to the presence of positive charges on the fiber. Cationized cotton has a high ecological impact as the amount of chemicals required to dye cotton textiles can be significantly reduced (e.g., by as much as 50%). Cationization increases dye use with no change or increase in color intensity. Cationic fibrous material offers a significant advantage to the textile industry because it can be dyed in less time using less energy and with reduced impact on the environment, while achieving higher color yields and fastness properties compared to those of conventionally dyed cotton.

In some embodiments, the present disclosure provides a method of functionalizing a fibrous material having a plurality of hydroxyl groups, the method including reacting the fibrous material with a compound of Formula I:

(I)

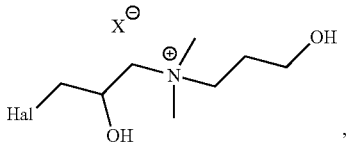

, where X is a monovalent counteranion for the quaternary ammonium cation of Formula I and Hal is a halogen atom, to obtain the functionalized fibrous material.

In some embodiments, Hal is Cl, Br, or I. In some embodiments, Hal is Cl or Br. In some embodiments, Hal is Cl.

In some embodiments, X is any counteranion that may balance the positive charge of the ammonium cation of the compound of Formula I. In some embodiments, X is Cl, Br, I, F, OH, $NO_3$, $HCO_3$, $HSO_4$, or $ClO_4$. In some embodiments, X is Cl, Br, or I. In some embodiments, X is Cl or Br. In some embodiments, X is Cl.

In some embodiments, the compound of Formula I is selected from any one of the following compounds:

(Ia)

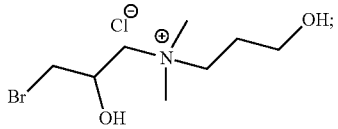

(Ib)

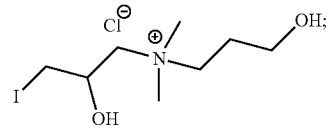

(Ic)

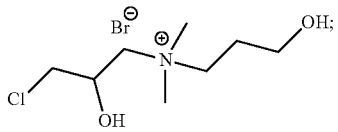

(Id)

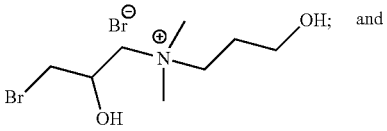

(Ie)

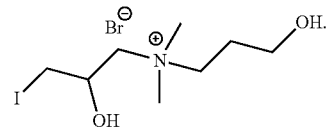

In some embodiments, the compound of Formula I is 3-chloro-2-hydroxy-N-(3-hydroxypropyl)-N,N-dimethylpropan-1-aminium chloride (CHPDMAP) having the following structure:

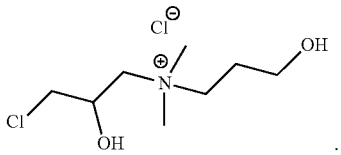

.

In some embodiments, the fibrous material includes cellulosic fibrous material. The cellulosic fibrous material may be a natural fibrous material (e.g., plant-based natural cellulosic fibrous material such as cotton, linen, bamboo, hemp, jute, or flax). In some embodiments, cellulosic fibrous material includes linen. In some embodiments, cellulosic fibrous material includes cotton. In some embodiments, the cotton is bleached. In some embodiments, the cotton is unbleached. The cotton may include from about 50% to about 100% cellulose (e.g., from about 60% to about 99%, from about 70% to about 95%, from about 75% to about 95%, from about 80% to about 95%, or from about 85% to about 95% cellulose). In some cases, cotton includes about 75%, about 80%, about 85%, about 90%, about 91%, about 92%, about 93%, about 94%, or about 95% cellulose. In certain cases, the weight of fibrous material including cotton is from about 50 g/m$^2$ to about 200 g/m$^2$, from about 60 g/m$^2$ to about 180 g/m$^2$, from about 75 g/m$^2$ to about 165 g/m$^2$, from about 100 g/m$^2$ to about 160 g/m$^2$, or from about 125 g/m$^2$ to about 155 g/m$^2$. In yet other cases, the weight of fibrous material including cotton is 125 g/m$^2$, about 135 g/m$^2$, about 140 g/m$^2$, about 145 g/m$^2$, about 150 g/m$^2$, about 155 g/m$^2$, about 160 g/m$^2$, or about 165 g/m$^2$.

In some embodiments, the cellulosic fibrous material is a synthetic fibrous material (e.g., synthetic cellulosic fibrous material prepared from purified cellulose such as wood pulp). The synthetic cellulosic fiber may be rayon (e.g., viscose, modal, tensel, or lyocell), or a blend of cellulosic fibrous material (e.g., natural or synthetic cellulosic fibrous material as described herein) and synthetic material (e.g., polyester, polyamide, polyolefin, acrylonitrile, acrylic, or nylon). In some cases, the fibrous material is a blend of cotton and polyester (e.g., 90/10, 80/20, 70/30, 65/35, 60/40, 50/50, 40/60, 35/65, 30/70, 20/80, or 10/90 cotton/polyester blend). In certain cases, the fibrous material is a blend of cotton and viscose (e.g., 90/10, 80/20, 70/30, 65/35, 60/40, 50/50, 40/60, 35/65, 30/70, 20/80, or 10/90 cotton/viscose blend). In yet other cases, the fibrous material is a blend of cotton and linen (e.g., 90/10, 80/20, 70/30, 65/35, 60/40, 50/50, 40/60, 35/65, 30/70, 20/80, or 10/90 cotton/linen blend).

The fibrous material may be in the form of a woven material, non-woven material, or knitted material. In one example, the fibrous material is a yarn or a filament. In another example, the fibrous material is woven and the weave of the woven is plain, poplin, oxford, pinpoint, fil-a-fil, twill, herringbone, dobby, flannel, seersucker, or satin.

In some embodiments, the reacting is carried out in the presence of a base (e.g., an organic base or an inorganic base). In some embodiments, the base is an inorganic base selected from $Mg(OH)_2$, $Ba(OH)_2$ and $Ca(OH)_2$. In some embodiments, the base is an inorganic base such as a metal carbonate (e.g., $K_2CO_3$, $CaCO_3$, $BaCO_3$, $Na_2CO_3$, $MgCO_3$, $Li_2CO_3$ or $Cs_2CO_3$). In some embodiments, the base is sodium acetate or potassium acetate. In some embodiments, the base is CaO or MgO. In some embodiments, the base is alkali hydroxide (e.g., NaOH, CsOH, LiOH, or KOH). In some embodiments, the base is sodium hydroxide (NaOH).

In some embodiments, the molar ratio of the base to the compound of Formula I is from about 1:100 to about 100:1, from about 1:75 to about 75:1, from about 50:1 to about 1:50, from about 1:25 to about 1:25, from about 1:10 to about 10:1, from about 1:5 to about 2:1, from about 1:2 to about 4:1, or from about 1:1 to about 2:1. In some embodiments, the molar ratio of the base to the compound of Formula I is about 5:1, about 4:1, about 3:1, about 2:1, about 1:1, about 1:2, about 1:3, about 1:4 or about 1:5. In some embodiments, the molar ratio of the base to the compound of Formula I is about 1:1. In some embodiments, the molar ratio of the base to the compound of Formula I is about 2:1.

In some embodiments, the base is NaOH, the compound of Formula I is CHPDMAP, and the molar ratio of NaOH to CHPDMAP is from about 1:5 to about 5:1, from about 1:4 to about 4:1, from about 1:3 to about 3:1, or from about 1:1 to about 2:1. In some embodiments, the molar ratio of NaOH to CHPDMAP is about 1:1. In other embodiments, the molar ratio of NaOH to CHPDMAP is about 2:1.

In some embodiments, the reacting is carried out in a solvent. In some embodiments, the reacting is carried out in an aqueous solvent. In some embodiments, the reacting is carried out in a non-aqueous solvent. In some embodiments, the reacting is carried out in a solvent selected from water, acetone, methanol, ethanol, isopropanol, ethylene glycol, and propylene glycol. In some embodiments, the reacting is carried out in a mixture of alcohol and water (e.g., 20/80, 30/70, 50/50, 70/30, or 80/20 mixture of water and methanol, ethanol, isopropanol, ethylene glycol, or propylene glycol). In some embodiments, the reacting is carried out in acetone. In some embodiments, the reacting is carried out in water.

In some embodiments, the reacting is carried out for a time period from about 2 min to about 3 days, from about 5 min to about 2 days, from about 10 min to about 2 days, from about 20 min to about 2 days, from about 30 min to about 24 hours, from about 45 min to about 20 hours, from about 1 hour to about 18 hours, from about 1.5 hours to about 15 hours, from about 2 hours to about 12 hours, from about 3 hours to about 10 hours, or from about 4 hours to about 8 hours. In some embodiments, the reacting is carried out for about 2 min, about 3 min, about 5 min, about 6 min, about 8 min, about 10 min, about 20 min, about 30 min, about 45 min, about 1 hour, about 1.5 hours, about 2 hours, about 2.5 hours, about 3 hours, about 4 hours, about 6 hours, about 8 hours, about 10 hours, about 12 hours, about 15 hours, about 18 hours, about 24 hours, or about 48 hours.

In some embodiments, the reacting is carried out at elevated temperature. In some embodiments, the reacting is carried out at ambient temperature. In some embodiments, the reacting is carried out at a temperature from about 15° C. to about 100° C., from about 25° C. to about 90° C., from about 30° C. to about 80° C., from about 20° C. to about 80° C., from about 25° C. to about 80° C., from about 20° C. to about 75° C., from about 20° C. to about 70° C., from about 20° C. to about 65° C., from about 20° C. to about 60° C., from about 20° C. to about 55° C., from about 20° C. to about 50° C., from about 20° C. to about 45° C., from about 20° C. to about 40° C., from about 20° C. to about 35° C., or from about 20° C. to about 30° C. In some embodiments, the reacting is carried out at 15° C., about 20° C., about 25° C., about 30° C., about 35° C., about 40° C., about 45° C., about 50° C., about 60° C., or about 80° C. In some embodiments, the reacting is carried out at about 25° C. In some embodiments, the reacting is carried out at room temperature.

In some embodiments, the fibrous material includes cotton, the reacting is carried out in the presence of a base, the compound of Formula I is CHPDMAP, the base is NaOH, the ratio of NaOH to CHPDMAP is from about 1:1 to about 2:1, the reacting is carried out in a solvent, the solvent is water, and the reacting is carried out for about 24 hours at room temperature.

In some embodiments, the reacting includes forming a covalent bond between the carbon atom to which Hal is attached and the oxygen atom of a hydroxyl group of the fibrous material. In some embodiments, the reacting includes breaking the C-Hal bond in the compound of Formula I and forming a covalent bond between the carbon atom to which the Hal was attached and the oxygen atom of a hydroxyl group of the fibrous material. In some embodiments, the reacting results in the functionalized fibrous material including at least one moiety of Formula II:

(II)

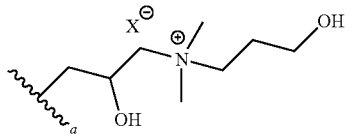

where X is as described herein and a denotes a point of attachment of the moiety of Formula II to the oxygen atom of a hydroxyl group of the fibrous material.

In some embodiments, the method of functionalizing a fibrous material having a plurality of hydroxyl groups is a performed as pad-batch process, an exhaust fixation process, a pad-steam process, a pad-dry-cure process, or any other fabric treatment process generally known in the art (e.g., any one of the aforementioned processes may be carried out as described, e.g., in U.S. Pat. No. 7,201,778; or in Wang et al., Carbohydrate Polymers 78 (2009) 602-608).

In some embodiments, the method of functionalizing a fibrous material having a plurality of hydroxyl groups includes (i) preparing a reaction mixture including a compound of Formula I (e.g., CHPDMAP) and a base (e.g., NaOH); (ii) contacting a fibrous material with the reaction mixture of (i) to obtain the functionalized fibrous material as described herein. In some embodiments, the preparing the reaction mixture of step (i) includes mixing a solution including the compound of Formula I (e.g., CHPDMAP) and a solution of a base (e.g., NaOH). In some embodiments, the solution of the compound of Formula I (e.g., CHPDMAP) is an aqueous solution with a concentration of the compound of Formula I (e.g., CHPDMAP) from about 10 wt. % to about 80 wt. %, from about 20 wt. % to about 75 wt. %, from about 25 wt. % to about 75 wt. %, from about 30 wt. % to about 70 wt. %, from about 40 wt. % to about 70 wt. %, or a solution of the compound of Formula I (e.g., CHPDMAP) is an aqueous solution with a concentration of the compound of Formula I (e.g., CHPDMAP) of about 25 wt. %, about 30 wt. %, about 35 wt. %, about 40 wt. %, about 45 wt. %, about 50 wt. %, about 55 wt. %, about 60 wt. %, or about 65 wt. %. In some embodiments, a solution of a base (e.g., NaOH) is an aqueous solution with a concentration of the base (e.g., NaOH) from about 5 wt. % to about 50 wt. %, from about 10 wt. % to about 45 wt. %, from about 10 wt. % to about 40 wt. %, from about 15 wt. % to about 40 wt. %, or from about 15 wt. % to about 30%. In some embodiments, a solution of a base (e.g., NaOH) is an aqueous solution with a concentration of the base (e.g., NaOH) of about 5 wt. %, about 10 wt. %, about 15 wt. %, about 20 wt. %, about 25 wt. %, or about 30 wt. %. In some embodiments, the contacting is carried out at liquor-to fiber ratio from about 100:1 to about 1:1, from about 90:1 to about 2:1, from about 80:1 to about 3:1, from about 70:1 to about 4:1, from about 60:1 to about 5:1, from about 50:1 to about 6:1, from about 40:1 to about 7:1, from about 30:1 to about 8:1, from about 20:1 to about 9:1, or from about 15:1 to about 10:1. In some embodiments, the contacting is carried out at liquor-to fiber ratio of about 1:1, about 2:1, about 3:1, about 4:1, about 5:1, about 6:1, about 8:1, about 10:1, about 15:1, about 20:1, or about 30:1. In some embodiments, when the compound of Formula I is CHPDAMP, mixing the solution of the compound of Formula I and the solution of the base results in the formation of the compound of Formula 1:

(1)

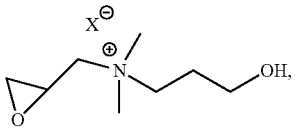

where X is as described herein, and the compound of Formula 1 further reacts with at least one hydroxyl group of the fibrous material.

In some embodiments, the method of functionalizing a fibrous material having a plurality of hydroxyl groups includes (i) treating the fibrous material with a base (e.g., NaOH); (ii) preparing a reaction mixture including a compound of Formula I and a base (e.g., as described herein); (iii) contacting the fibrous material that was treated with a base with the reaction mixture of step (ii) to obtain the functionalized fibrous material as described herein. In some embodiments; the treating includes impregnating the fibrous material with a solution of a base (e.g., any one of the base solutions as described herein). In some embodiments, the impregnating is conducted for a time period from about 1 min to about 24 hours, from about 1 min to about 18 hours, from about 1 min to about 12 hours, from about 1 min to about 6 hours, from about 1 min to about 1 hour, from about 2 min to about 45 min, from about 2 min to about 20 min, or from about 2 min to about 15 min. In some embodiments, the impregnating is carried out for about 1 min, about 2 min, about 3 min, about 5 min, about 7 min, about 10 min, about 12 min, about 15 min, about 20 min, about 30 min, or about 1 hour.

In some embodiments, functionalizing a fibrous material having a plurality of hydroxyl groups includes (i) treating the fibrous material with a base (e.g., with a solution of a base as described herein); and (ii) contacting the fibrous material that was treated with a base with a compound of Formula I (e.g., with a solution of the compound of Formula I (e.g., CHPDMAP) as described herein) to obtain the functionalized fibrous material.

In some embodiments, the method of functionalizing a fibrous material having a plurality of hydroxyl groups further includes washing (e.g., rinsing with water) the functionalized fibrous material to obtain the functionalized fibrous material that is free from the unreacted compound of Formula I.

In some embodiments, functionalizing a fibrous material having a plurality of hydroxyl groups occurs according to Scheme 1a or Scheme 1b.

Scheme 1a

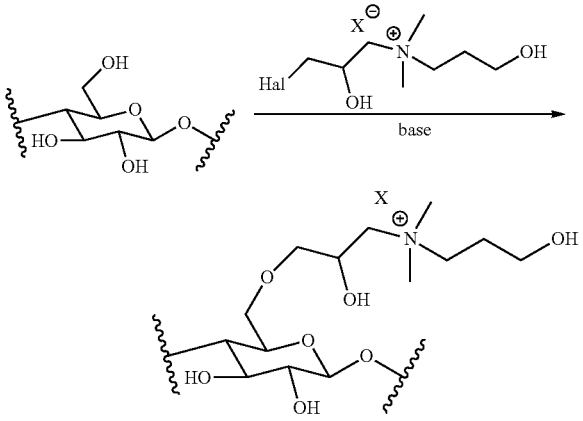

Scheme 1b

-continued

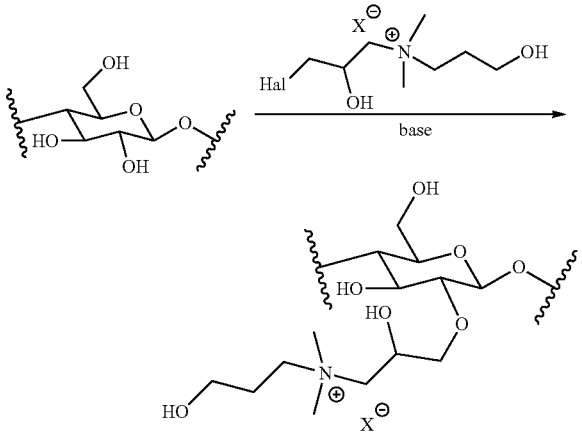

Referring to Schemes 1a and 1b, the compound of Formula I reacts with at least one hydroxyl group of the fibrous material. The reacting includes a formation of a new covalent bond between the carbon atom to which Hal is attached in the compound of Formula I and the oxygen atom of a hydroxyl group of the fibrous material. Any one of the functionalized structures as depicted in Schemes 1a and 1b can further react with the compound of Formula I, such that, for example, all hydroxyl groups in such structures are functionalized with the structure of Formula II.

In some embodiments, the process of functionalizing a fibrous material having a plurality of hydroxyl groups as described herein is advantageously carried out at low temperature (e.g., at room temperature), to achieve maximum fixation and minimum loss of the compound of Formula I due to hydrolysis of the compound of Formula I (see, e.g., Scheme 2).

Scheme 2

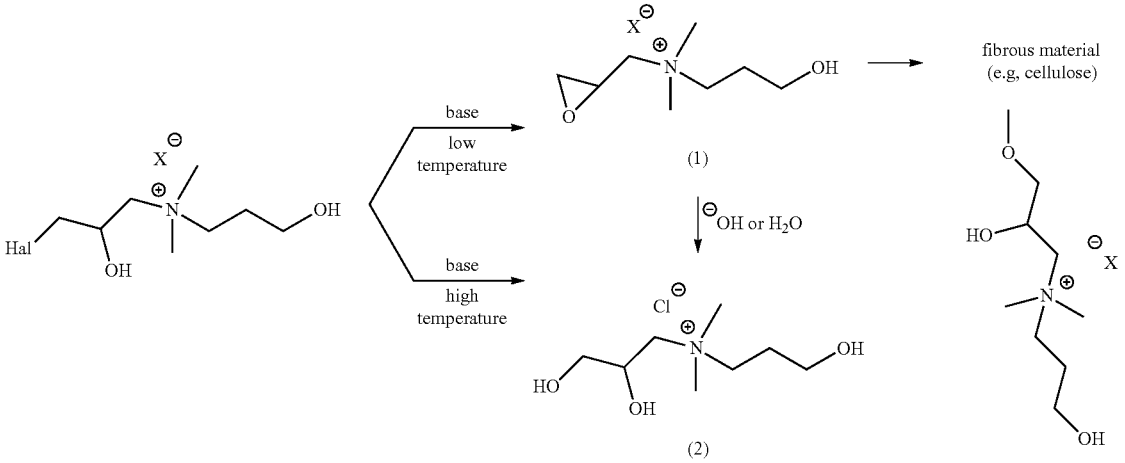

Referring to Scheme 2, the reaction between the compound of Formula I and the fibrous material having a plurality of hydroxyl groups occurs in two steps. In the first step, the compound of Formula I reacts with a base to form the glycidoxy intermediate of Formula 1. In the second step, this glycidoxy intermediate of Formula 1 reacts with fibrous material having a plurality of hydroxyl groups to form the functionalized fibrous material as described herein. In the high-temperature process, the increased production of the hydrolyzed intermediate (2) is observed. At high temperature, the compound of Formula I reacts with either the solvent (e.g., water) or the hydroxyl anion (when the base is a hydroxide) at a higher rate and results in the increased production of the hydrolyzed intermediate (2). At the same time, the glycidoxy intermediate at higher temperature may also react with the solvent (e.g., water) or the hydroxyl anion (when the base is a hydroxide), thus contributing to the increased production of the hydrolyzed intermediate (2) and the decreased formation of the cationized fibrous material. The process of the present application advantageously avoids the use of toxic non-aqueous solvents and thus decreases the effluent pollution while increasing the efficiency and decreasing the cost of the cationization process by avoiding waste of the compound of Formula I.

In some embodiments, the compound of Formula I may be prepared according to Scheme 3.

Scheme 3

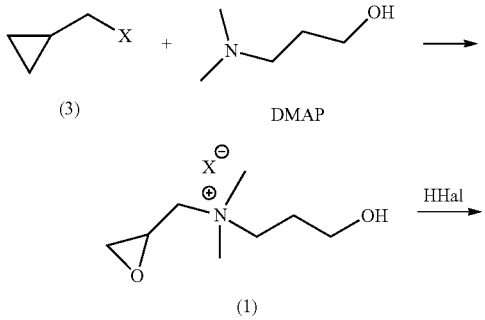

-continued

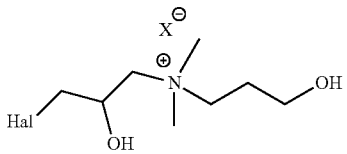

Formula I

Referring to Scheme 3, the epihalohydrin (3) may be reacted with the 3-(dimethylamino)propan-1-ol (DMAP) to obtain the glycidoxy intermediate of Formula 1, which, in turn, may be reacted with HHal to obtain the compound of Formula I.

In some embodiments, the present application provides the method of making a compound of Formula I:

(I)

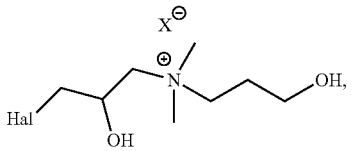

where X is as described herein, including reacting a compound of Formula 1:

(1)

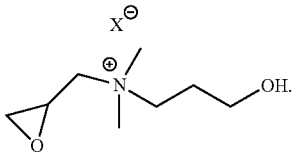

with HHal to produce the compound of Formula I.

In some embodiments, HHal is selected from HCl, HBr and HI. In some embodiments, HHal is selected from HCl and HBr. In some embodiments, HHal is HBr. In some embodiments, HHal is HCl.

In some embodiments, the reacting is carried out at room temperature. In some embodiments, the reacting is carried out in a solvent. In some embodiments, the solvent is water. In some embodiments, the concentration of the compound of Formula 1 in the aqueous solution is from about 10 wt. % to about 80 wt. %, from about 15 wt. % to about 70 wt. %, from about 20 wt. % to about 60 wt. %, from about 30 wt. % to about 60 wt. %, or from about 40 wt. % to about 60 wt. %. In some embodiments, the concentration of the compound (1) in the aqueous solution is about 20 wt. %, about 30 wt. %, about 40 wt. %, about 50 wt. %, about 60 wt. %, or about 70 wt. %. In some embodiments, reacting is carried out by dropwise addition of HHal to the aqueous solution of the compound of Formula 1. In some embodiments, an aqueous solution of HHal is added to the aqueous solution of the compound of Formula 1 and the concentration of the aqueous solution of HHal (e.g., HCl) is from about 10% to about 36%, from about 15% to about 36%, from about 20% to about 36%, or from about 25% to about 36% (e.g., about 10%, about 20%, about 25%, about 30%, or about 36%). In some embodiments, an aqueous solution of HHal is added to the aqueous solution of the compound of Formula 1 and the concentration of the aqueous solution of HHal (e.g., HCl) is about 36%. In some embodiments, reacting is carried out for a length of time of about 1 min to about 1 hour, from about 2 min to about 50 min, from about 3 min to about 45 min, from about 4 min to about 40 min, from about 5 min to about 35 min, or from about 10 min to about 30 min. In some embodiments, reacting is carried out for 1 min, 5 min, 10 min, 15 min, 20 min, 25 min, 30 min, 35 min, or 45 min. In some embodiments, reacting is carried out at pH from about 1 to about 6, from about 1 to about 5, or from about 2 to about 4. In some embodiments, reacting is carried out at pH of 1, 2, 3, 4, 5, or 6. In some embodiments, the reacting is carried out at pH 4.

In some embodiments, preparing the compound of Formula 1:

(1)

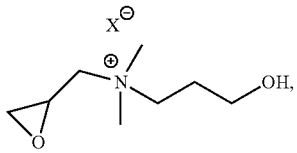

where X is as described herein, includes reacting a DMAP of formula:

(DMAP)

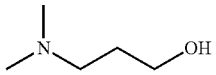

with an epihalohydrin of Formula 3:

(3)

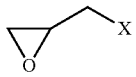

to obtain the compound of Formula 1.

In some embodiments, the reacting includes adding an aqueous solution of HHal (e.g., HCl) to DMAP to obtain a reaction mixture. In some embodiments, the concentration of aqueous solution of HHal (e.g., HCl) is from about 10% to about 36%, from about 15% to about 36%, from about 20% to about 36%, or from about 25% to about 36%. In some embodiments, the concentration of the aqueous solution of HHal (e.g., HCl) is about 10%, about 20%, about 25%, about 30% or about 36%. In some embodiments, concentration of aqueous solution of HHal (e.g., HCl) is about 36%. In some embodiments, adding of the HHal solution is carried out at room temperature. In some embodiments, adding of the HHal solution is carried out at a temperature from about 10° C. to about 20° C. In some embodiments, adding of the HHal solution is carried out for about 30 min. In some embodiments, adding of the HHal solution is followed by stirring the reaction mixture for about 1 hour. In some embodiments, epihalohydrin is added to the reaction mixture dropwise over a length of time of about 1 hour. In some embodiments, adding of the epihalohydrin is carried out at a temperature from about 0° C. to about 20° C., from about 2° C. to about 15° C., from about 3° C. to about 10° C., or from about 4° C. to about 8° C. In some embodiments, adding of the epihalohydrin is carried out at about 0° C., about 5° C., about 10° C., or about 15° C. In some embodiments, adding of the epihalohydrin is carried out at about 5° C. (e.g., as a result of cooling the reaction mixture with an ice bath). In some embodiments, reacting is carried out for a time period from about 1 hour to about 2 days, from about 2 hours to about 24 hours, or from about 6 hours to about 24 hours at about room temperature. In some embodiments, the reacting is carried out for about 2 hours, about 6 hours, about 10 hours, about 18 hours, about 24 hours, or overnight at about room temperature (e.g., about 20° C.). In some embodiments, the reacting is carried out such that the reaction mixture warms up from about 5° C. to about room temperature as a consequence of ice melting in the ice bath. In some embodiments, the reacting at room temperature is followed by reacting at a temperature from about 20° C. to about 80° C., from about 25° C. to about 75° C., from about 30° C. to about 70° C., or from about 35° C. to about 65° C. for a time period from about 1 hour to about 24 hours, from about 2 hours to about 12 hours, or from about 2 hours to about 6 hours. In some embodiments, reacting at room temperature is followed by reacting at about 60° C. for about 2 hours, about 3 hours or about 4 hours. In some embodiments, the compound of Formula 1 may be isolated by rotary evaporation at about 60° C. (e.g., as a water-soluble syrup). In some embodiments, the compound of Formula 1 may be isolated by evaporating water at about 110° C. for about 1 hour.

In some embodiments, the epihalohydrin of Formula 3 may be selected from any one of the following compounds:

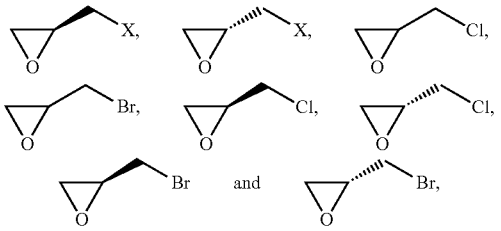

where X is as described herein.

In some embodiments, the epihalohydrin of Formula 3 is selected from epichlorohydrin (2-(bromomethyl)oxirane, e.g., CAS Registry No. 106-89-8, 67843-74-7, or 51594-55-9) and epibromohydrin (2-(bromomethyl)oxirane, e.g., CAS Number 3132-64-7).

In some embodiments, the epihalohydrin of Formula 3 is a compound of formula:

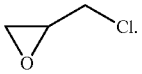

In some embodiments, the compound of Formula I (e.g., CHPDMAP) is in a form of an aqueous solution with a concentration of the compound of Formula I (e.g., CHPDMAP) in the aqueous solution from about 10 wt. % to about 80 wt. %, from about 20 wt. % to about 75 wt. %, from about 25 wt. % to about 75 wt. %, from about 30 wt. % to about 70 wt. %, from about 40 wt. % to about 70 wt. %, or from about 40 wt. % to about 60 wt. %. In some embodiments, the compound of Formula I (e.g., CHPDMAP) is in a form of an aqueous solution with a concentration of the compound of Formula I (e.g., CHPDMAP) in the aqueous solution of about 25 wt. %, about 30 wt. %, about 35 wt. %, about 40 wt. %, about 45 wt. %, about 50 wt. %, about 55 wt. %, about 60 wt. %, or about 65 wt. %

In some embodiments, the present disclosure does not provide a method of functionalizing a fibrous material having a plurality of hydroxyl groups including reacting the fibrous material with a compound of Formula III:

(III)

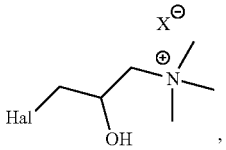

where X and Hal are as described herein, to obtain the functionalized fibrous material.

When the compound of Formula III (e.g., 3-chloro-2-hydroxypropyl trimethyl ammonium chloride (CHPTAC)) is used to produce the functionalized fibrous material, the resultant fibrous material is malodorous. For example, the resultant fibrous material functionalized with CHPTAC possesses odor with the degree of offensiveness of 4-10 (out of 10) (e.g., with the degree of offensiveness of about 4, 5, 6, 7, 8, 9, or 10). In another example, the resultant fibrous material functionalized with CHPTAC possesses the odor with odor intensity (on a six-point scale, as discussed below) from 1-5 (e.g., odor intensity of 1, 2, 3, 4, or 5). The foul odor of the fibrous material produced by reacting the fibrous material with the compound of Formula III results from the release of the trimethylamine, for example, as shown in Scheme 4 below:

Scheme 4

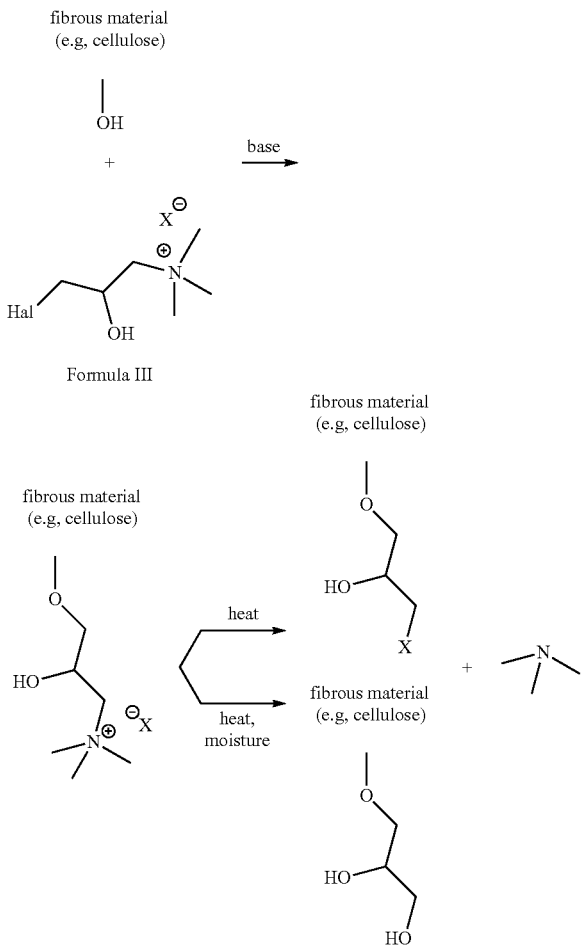

Referring to Scheme 4, a fibrous material having a plurality of hydroxyl groups is reacted with the compound of Formula III (e.g., CHPTAC) to form fibrous material that is functionalized with a moiety of Formula IVa:

(IVa)

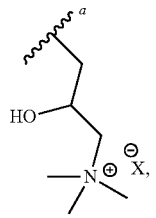

wherein a indicates a point of attachment of the moiety to the oxygen atom of a hydroxyl group of the fibrous material. When the fibrous material functionalized with a moiety of Formula IVa is exposed to heat, moisture, or both, the moiety of Formula IVa decomposes to form a moiety of Formula IVb, Formula IVc, or both:

(IVb)

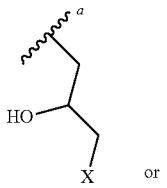

or (IVc)

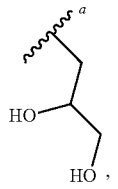

where a indicates a point of attachment of the moiety to the oxygen atom of a hydroxyl group of the fibrous material) while simultaneously releasing free trimethylamine. The smell of trimethylamine resembles the smell of rotten fish. Most humans find the smell of trimethylamine offensive.

In some embodiments, the present application provides a functionalized fibrous material prepared by any one of the processes described herein.

In some embodiments, the present application provides a fibrous material having a plurality of hydroxyl groups, wherein at least one hydroxyl group of the fibrous material is functionalized with a moiety of Formula II:

(II)

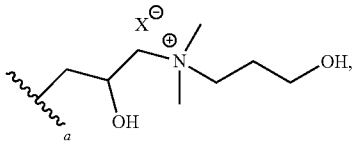

where X is a as described herein, and a denotes a point of attachment of the moiety of Formula II to the oxygen atom of the hydroxyl group of the fibrous material.

In some embodiments, the functionalized (e.g., cationized) fibrous material of the present disclosure has an odor (e.g., odor of free 3-(dimethylamino)propan-1-ol (DMAP)) below the threshold of detection. In some embodiments, the functionalized fibrous material of the present disclosure has an odor of the free amine at the threshold of detection. In some embodiments, the functionalized fibrous material of the present disclosure is substantially odorless. In some embodiments, the functionalized fibrous material of the present disclosure has an odor with degree of offensiveness of about 3 (out of 10) or less. In some embodiments, the functionalized fibrous material of the present disclosure has an odor with degree of offensiveness of about 2 (out of 10) or less. In some embodiments, the functionalized fibrous material of the present disclosure has an odor with degree of offensiveness of about 0 (no odor), about 1 (not offensive), or about 2 or about 3. In some embodiments, the functionalized fibrous material of the present disclosure has an odor with the odor intensity (on a six-point scale) of 0 or 1. In some embodiments, the functionalized fibrous material of the present disclosure has an odor with the odor intensity (on a six-point scale) of 0 (no odor). The system for representing odor intensity on a 6-point scale is summarized in Table 1.

TABLE 1

System for representing odor intensity on a 6-point scale

| Odor intensity | Description |
|---|---|
| 0 | No odor |
| 1 | Odor that can only just be sensed (detection threshold concentration) |
| 2 | Slight odor by which the odor can be identified (recognition threshold concentration) |
| 3 | Odor that can easily be sensed |
| 4 | Strong odor |
| 5 | Intense odor |

The threshold of odor detection is the substance concentration at which an assessor/panelist can determine (e.g., by unaided olfactory senses) a difference between the odorless sample and the sample in which an odor can just be sensed. That is, at the threshold of odor detection an assessor/panelist recognizes the stimulus as the chemical substance evokes a sensory response (e.g., unaided olfactory sense response) in the assessor/panelist. In some embodiments, the preparation of samples, panel formation, experimental procedures, and data processing for the determination of threshold of odor detection are conducted, for example, as described in International Standard ISO 13301 (Sensory analysis—Methodology—General guidance for measuring odor, flavor and taste detection thresholds by a three-alternative forced-choice (3-AFC) procedure), the disclosure of which is incorporated herein by reference in its entirety. In some embodiments, the threshold of odor detection may be measured as described, for example, in Abraham et. al, Chem Senses. 2012, 37(3), 207-218 or Devos et. al., Standardized human olfactory thresholds, Oxford: IRL Press at Oxford University Press; 1990, the disclosures of the foregoing are incorporated herein by reference in their entireties. In some embodiments, the threshold of odor detection of 3-(dimethylamino)propan-1-ol (DMAP) sample is measured by taking a sample the smell of DMAP in which all panel members can sense, and further diluting the sample (e.g., in a 100-, 50-, 10-, 6-, or 5-dilution series) until at least 50% of the panel members can no longer identify which of the diluted samples has the odor of DMAP and which sample is odorless. In some embodiments, after the DMAP odor threshold determination, at least 50% of the panel members determine that the functionalized fibrous material of the present disclosure is odorless (odor of DMAP is below the threshold of detection) or has an odor of DMAP at the threshold of detection. In some embodiments, the threshold of odor detection of DMAP is about 1 ppm or less, about 0.5 ppm or less, about 0.1 ppm or less, about 0.09 ppm or less, about 0.08 ppm or less, about 0.07 ppm or less, about 0.06 ppm or less, about 0.05 ppm or less, about 0.025 ppm or less, about 0.01 ppm or less, or about 0.005 ppm or less, and the functionalized fibrous material of the present disclosure has an odor of DMAP below the threshold of detection or at the threshold of detection.

Furthermore, odor can be evaluated using assessors/panelists to rank samples, a procedure in which an arbitrary scale is used to describe either the intensity or offensiveness of an odor. In some embodiments, a scale of 0 to 10 is used, with 0 indicating no odor (or not offensive odor) and 10 representing a very intense or offensive odor. In this 10-point scale system, the degree of offensiveness of an odor is 0 when at least 50% of the panel members determine that the odor of a sample is not offensive (or no odor), and the degree of offensiveness of an odor is 10 when at least 50% of the panel members determine that the odor of a sample is most offensive. The degree of offensiveness is 1 or 2 when at least 50% of the panel members determine that the odor of a sample is detectable but tolerable for a prolonged period of time. Similarly, the odor intensity may be measured on a 6-point scale (see, e.g., Table 1). The odor intensity is 0 when at least 50% of the panel members determine that the sample is odorless, while the odor intensity is 5 when at least 50% of the panel members determine that the odor is intense (not tolerable even for a short period of time).

The present disclosure unexpectedly provides the functionalized fibrous material in which the odor of free amine (DMAP) is below or just at the threshold of detection, the odor has degree of offensiveness of less than about 3 (out of 10), and the odor intensity (on a six-point scale) is 0 (no odor) or 1. These results were unexpected because the functionalized fibrous material of the present disclosure having a moiety of Formula II may release the free amine (DMAP) according to the same mechanism by which the fiber functionalized with the moiety of Formula IVa releases free trimethylamine (as shown in Scheme 4). See, for example, Scheme 5:

Scheme 5

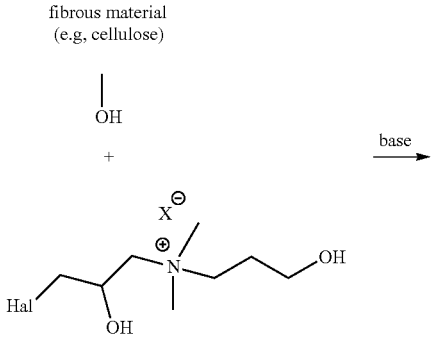

Formula I

-continued

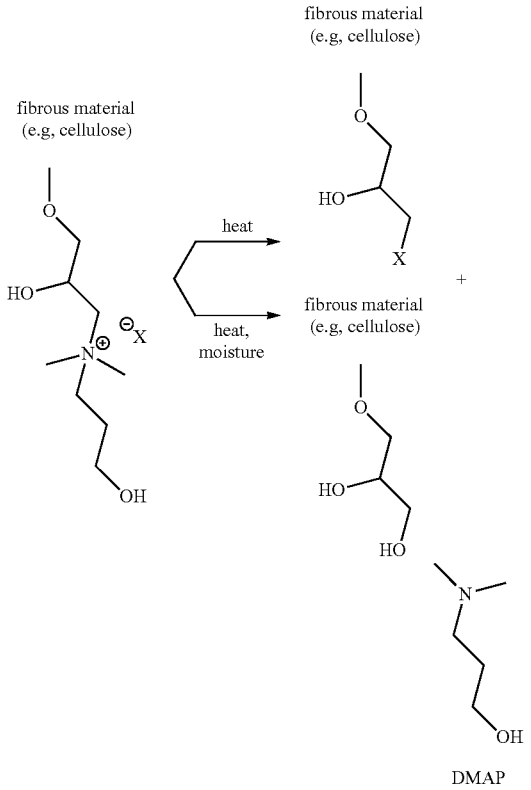

The boiling point (and concomitantly the vapor pressure) of DMAP is similar to the boiling point ranges (and the vapor pressure) of the substances the smell of which humans commonly find offensive (e.g., styrene, xylene, propionic acid, butyric acid, valeric, and isovaleric acid, summarized in Table 2). One would expect that a fibrous material that may contain at least some amount of DMAP would possess an offensive smell. Nevertheless, the functionalized fibrous material of the present application is advantageously odorless or has the odor of DMAP with degree of offensiveness of less than 3 (out of 10), odor intensity of 0 or 1 (on a 6-point scale), or both.

TABLE 2

Summary of offensive odor substances

| Chemical substance | Boiling point | Common odor |
|---|---|---|
| 3-(dimethylamino)propan-1-ol (DMAP) | 163-164° C. | Smells like dead/rotten fish |
| Styrene | 145° C. | Smells like city gas |
| Xylene | 138-144° C. | Smells like gasoline |
| Propionic acid | 141.2° C. | Irritating sour smell |
| n-Butyric acid | 163.5° C. | Smells of sweat |
| n-Valeric acid | 186-187° C. | Smells like musty socks |
| Isovaleric acid | 175-177° C. | Smells like musty socks |

The functionalized (e.g., cationized with moiety of Formula II) fibrous material of the present disclosure advantageously increases ionic attraction between dye and the fibrous material (e.g., cationized cotton). In some embodiments, the functionalized fiber of the present application has more positive zeta potential (ζ) than the untreated fabric. In some embodiments, the ζ of the functionalized fiber is from about −40 mV to about +5 my, from about −35 mV to about +4 mV, from about −30 mV to about +2 mV, from about −25 mV to about 0 my, from about −19 mV to about −1 mV, from about −18 mV to about −2 mV, from about −17 mV to about −3 mV, from about −16 mV to about −4 mV, or from about −15 mV to about −5 mV. In some embodiments, the ζ is about −20 mV, about −19 mV, about −18 my, about −17 mV, about −16 mV, about −15 mV, about −14 mV, about −13 mV, about −12 mV, about −11 mV, about −10 mV, about −5 mV, about 0 mV, about +1 mV, about +2 mV, about +3 my, about +4 mV, or about +5 mV as measured at pH 10.

In some embodiments, the % of nitrogen content (as determined, e.g., by elemental analysis using a hydrogen-carbon-nitrogen (HCN) elemental analyzer) in the functionalized fabric may be used to determine the amount of the compound of Formula I (e.g., CHPDMAP) that reacted with the hydroxyl groups of the fibrous material. In some embodiments, the degree of cationization (% of nitrogen content) of the functionalized fabric of the present disclosure is from about 0.001% to about 1%, from about 0.005% to about 0.9%, from about 0.01% to about 0.8%, from about 0.02% to about 0.7%, from about 0.03% to about 0.6%, from about 0.05% to about 0.5%, from about 0.06% to about 0.4%, from about 0.07% to about 0.35%, or from about 0.1% to about 0.3%. In some embodiments, the degree of cationization (% of nitrogen content) of the functionalized fabric of the present disclosure is about 0.005%, about 0.01%, about 0.02%, about 0.03%, about 0.04%, about 0.05%, about 0.06%, about 0.07%, about 0.08%, about 0.09%, about 0.1%, about 0.15%, about 0.2%, about 0.25%, about 0.3%, about 0.35%, about 0.5%, about 0.55%, about 0.6%, about 0.7%, about 0.8%, or about 1%.

In some embodiments, the utilization efficiency of the compound of Formula I (e.g., CHPDMAP) may be determined as % of total applied compound of Formula I that reacted with hydroxyl groups of the fiber (based on the nitrogen analysis of the fiber). In a pad batch process, the total amount of nitrogen in a batch can always be calculated based on the concentration of the solution and the molecular weight of the compound of Formula I. Knowing the weight of the treated fiber, the total % nitrogen available for incorporation into the structure of the fiber may be calculated (e.g., 5 g of nitrogen in the total mass of compound of Formula I per 1 kg of fibrous material will provide for a theoretic yield of 0.5% nitrogen incorporation). The actual amount of fixed nitrogen may be determined by elemental analysis as described above. The actual amount divided by the theoretical amount provides for the utilization efficiency (% fixation). In some embodiments, the processes described herein provide for the cationization reagent utilization efficiency from about 10% to about 100%, from about 15% to about 95%, from about 20% to about 90%, from about 25% to about 90%, from about 30% to about 90%, from about 35% to about 90%, from about 40% to about 90%, from about 45% to about 90%, from about 50% to about 90%, from about 55% to about 90%, from about 60% to about 90%, or from about 70% to about 90%. In some embodiments, the processes described herein provide for a cationization reagent utilization efficiency of about 25%, about 30%, about 35%, about 40%, about 45%, about 50%, about 55%, about 60%, about 65%, about 70%, about 75%, about 80%, about 90%, or about 95%.

In some embodiments, the present disclosure provides a method of dyeing a fibrous material as described herein, the method including contacting the fibrous material with a dye.

In some embodiments, contacting can be carried out by any method of dyeing fabric generally known in the art. For example, the fabric may be dyed as described in Khatri et. al., A review on developments in dyeing cotton fabrics with reactive dyes for reducing effluent pollution, *Journal of Cleaner Production,* 2014, 1-8 and references cited therein, the disclosures of which are incorporated herein by reference in their entireties. Depending on the type of fibrous material, scale, and dye, a skilled chemical engineer would be able to select and implement appropriate tools, apparatuses, and methods to successfully dye the functionalized fibrous material described herein.

In some embodiments, the dye is a reactive dye.

In some embodiments, the dye is a vinylsulphone dye, monochlorotriazine dye, monofluorochlorotriazine dye, dchlorotriazine dye, difluorochloropyrimidine dye, dichloroquinoxaline dye, trichloropyrimidine dye, or a vinyl amide dye.

In some embodiments, the dye is an acid dye. In some embodiments, any one of the acid dyes described herein includes at least one group selected from carboxylic acid —C(═O)OH, sulfonic acid —S(═O)$_2$OH, and phosphonate —P(═O)(OH)$_2$.

In some embodiments, the dye is selected from the group consisting of Reactive Red M5B, Reactive Red-2, Reactive Red M8B, Reactive Red-11, Reactive Magenta MB, Reactive Violet-13, Reactive Orange M2R, Reactive Orange-4, Reactive Orange M2RJ, Reactive Gol. Yellow MR, Reactive Yellow-44, Reactive Yellow MR EX H/C, Reactive Yellow-44, Reactive Yellow M3R, Reactive Yellow-36, Reactive Yellow M4R, Reactive Orange-14, Reactive Yellow M8G, Reactive Yellow-86, Reactive Yellow M4G, Reactive Yellow-22, Reactive Yellow MGR, Reactive Yellow-7, Reactive Violet C4R, Reactive Violet-12, Reactive Violet C2R, Reactive Violet-14, Reactive Blue MR, Reactive Blue-4, Reactive Blue-5, Reactive Blue M2R, Reactive Blue-81, Reactive Blue M2R H/C, Reactive Blue-81, Reactive Navy Blue M3R, Reactive Blue-9, Reactive Blue M4GD H/C, Reactive Blue-168, Reactive Tur. Blue MGN, Reactive Blue-140, Reactive Tur. Blue Ha5G, Reactive Blue-71, Reactive Blue-19, Reactive Yellow HE6G, Reactive Yellow-135, Reactive Yellow HE4R, Reactive Yellow-81, Reactive Yellow HE4R, Reactive Yellow-84, Reactive G. Yellow HE4R, Reactive Yellow-81-A, Reactive Orange HER, Reactive Orange-84, Reactive Orange HE2R, Reactive Orange-84-A, Reactive Red HE3B, Reactive Red-120, Reactive Red HE5B, Reactive Red HE7B, Reactive Red-141, Reactive Red-45:1, Reactive Red HE8B, Reactive Red-152, Reactive Red-22, Reactive Green HE 4B, Reactive Green-19, Reactive Green HE 4BD, Reactive Green-19A, Reactive Black HEBL, Reactive Navy Blue HER, Reactive Blue-171, Reactive Navy Blue HE2R, Reactive Blue-172, Reactive Blue HERD, Reactive Blue-160, Reactive Navy Blue HEGN, and Reactive Blue-198.

In some embodiments, the dye is selected from CI Acid red 128, CI Acid red 14, CI Acid Red 114, CI Acid Orange 3, CI Acid Red 97, C.I. Acid Blue 7, C.I. Acid Blue 9, C.I. Acid Orange 7, and C.I. Acid Green 28.

In some embodiments, the % dye retention (dye fixation degree, determined as the ratio of color intensity of the washed dyed fabric to the color intensity of the dyed fabric prior to washing) of the dyed functionalized fibrous material prepared according to the methods described herein is from about 50% to about 100%, from about 50% to about 99%, from about 60% to about 95%, from about 65% to about 95%, from about 70% to about 95%, or from about 75% to about 95%. In some embodiments, the dye fixation degree is about 50%, about 60%, about 70%, about 75%, about 80%, about 85%, about 90%, about 95%, about 99%, or about 100%.

In some embodiments, the % dye intensity increase (determined as the ratio of the difference between color intensity dyed functionalized and dyed untreated fabric to the color intensity of untreated fabric) of the dyed fabric that is functionalized according to the methods of the present application is from about 10% to about 200%, from about 20% to about 180%, from about 30% to about 170%, from about 40% to about 150%, from about 50% to about 140%, from about 60% to about 120%, or from about 80% to about 100%. In some embodiments, the % dye intensity increase is about 10%, about 20%, about 30%, about 40%, about 50%, about 60%, about 70%, about 80%, about 90%, about 100%, about 120%, about 150%, or about 200%.

In some embodiments, the dyed functionalized fibrous material described herein is useful in making articles of clothing (any article of clothing conventionally known in the textile industry, such as, for example, underwear (e.g., garments, boxers, briefs, bras, panties, hosiery, brassieres, or camisoles), pants, trousers, khakis, jeans, shirts, shorts, skirts, blouses, tees, tanks, sweaters, dresses, suits, jackets, swimming suits, saris, protective clothing, socks, coats, scarves, footwear, or hats). Any other article of manufacture that is known to be made from a textile material can also be prepared from the fibrous material of the present application.

Definitions

As used herein, the term "threshold of detection" refers to dilution level at which an assessor/panelist can determine by the unaided olfactory senses a difference between the diluted and the odorless samples.

Odor can be evaluated using assessors/panelists to rank samples, a procedure in which an arbitrary scale is used to describe the offensiveness of an odor. A scale of 0 to 10 may be used, with 0 indicating no odor or not offensive and 10 representing a very intense or offensive odor. As used herein, the term "degree of offensiveness" refers to a sample rank on a scale from 0 to 10.

As used herein, the term "aqueous solvent" refer to a liquid including at least 50%, at least 60%, at least 70%, at least 90%, or at least 95% water. In some embodiments, the aqueous solvent is water.

As used herein, the term "hydroxyl" refers to an —OH group.

As used herein, the term "halo," "halide," or "halogen" refers to fluoro, chloro, bromo, and iodo groups.

As used herein, the term "cellulose" or "cellulosic" refers to a complex polysaccharide molecule that is composed of disaccharide subunits having two D-glucopyranoses joined by 1,4'-β-glycoside bond (e.g., 4-β-glucopyranosyl-D-glucopyranose).

As used herein, the term "reacting" is used as known in the art and generally refers to the bringing together of chemical reagents in such a manner so as to allow their interaction at the molecular level to achieve a chemical or physical transformation. In some embodiments, reacting involves at least two reagents. In some embodiments, a reacting step of a synthetic process involves one or more substances in addition to the reagents such as solvent, a catalyst, or both. The reacting steps of the processes described herein can be conducted for a time and under conditions suitable for preparing the identified product. The terms "combining" and "mixing" with respect to reagents of a chemical reaction are used interchangeably with the term "reacting" herein. The term "coupling" also can be considered interchangeable with "reacting" but may be used in conjunction with a reaction step that involves the linking of two organic fragments.

EXAMPLES

Example 1—Preparation of GlycidoxyDMAP and CHPDMAP

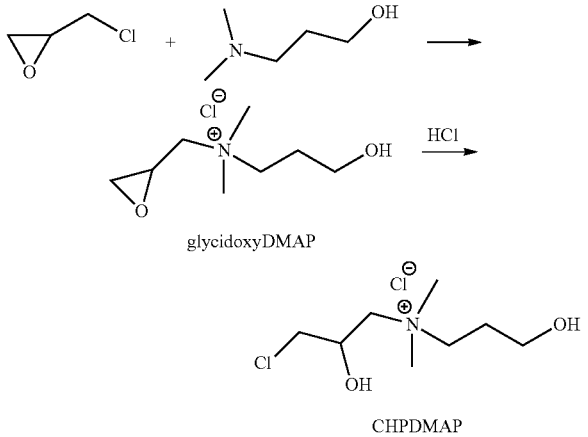

A. Product Preparation with Water Removal by Rotary Evaporation

HCl (1.00 mol, 36%, 100 mL) was added dropwise to 3-(dimethylamino)propan-1-01 (DMAP, CAS Registry No. 3179-63-3) (1.00 mol, 103 g) over 0.5 h with the temperature maintained between 10-20° C. The resultant solution was stirred for 1 h at room temperature and then cooled to 5° C. Epichlorohydrin (EPI, CAS Registry No. 106-89-8) (1.05 mol, 97 g) was added to the reaction mixture dropwise over 1 h. The reaction mixture was stirred overnight, warming to 20° C. as a consequence of the ice melting. The following day the reaction mixture was stirred for 4 h at 60° C., after which time the pH of the solution was about 5. Water was removed by rotary evaporation at 60° C. to give a water-soluble syrup. The product was weighed, and water was added as needed to obtain a 50% w/w solution. HCl (36%, 1 mL) was added dropwise to pH=4 to obtain the ring-open product 3-chloro-2-hydroxy-N-(3-hydroxypropyl)-N,N-dimethylpropan-1-aminium chloride (CHPDMAP).

B. Product Preparation without Water Removal

HCl (1.00 mol, 36%, 100 mL) was added dropwise to DMAP (1.00 mol, 103 g) over 0.5 h with the temperature maintained between 10-20° C. The resultant solution was stirred for 1 h at room temperature and then cooled to 5° C. EPI (1.05 mol, 97 g) was added dropwise to the reaction mixture over 1 h. The reaction mixture was stirred overnight, warming to 20° C. as a consequence of the ice melting. The following day the reaction mixture was stirred for 4 h at 60° C. The product was weighed and water was added as needed to obtain a 50% w/w solution. The final pH of the mixture containing the ring-open product 3-chloro-2-hydroxy-N-(3-hydroxypropyl)-N,N-dimethylpropan-1-aminium chloride (CHPDMAP) was about 5.

C. 60° C. Procedure

HCl (1.00 mol, 36%, 100 mL) was added dropwise to 3-dimethyl amino-1-propanol (DMAP, CAS 3179-63-3) (1.00 mol, 103 g) over 0.5 h, and the temperature was maintained between 10-20° C. The resultant solution was cooled to 5° C. Epichlorohydrin (EPI, CAS 106-89-8) (1.2 mol, 111 g) was added dropwise over 1 h. The reaction mixture was stirred for 2 h, warming to 20° C. as a consequence of the ice melting. The mixture was heated to 60° C. and stirred for 3 h at 60° C. The product was weighed and water was added as needed to obtain a 50% w/w solution. The final pH of the mixture containing the ring-open product 3-chloro-2-hydroxy-N-(3-hydroxypropyl)-N, N-dimethylpropan-1-aminium chloride (CHPDMAP) was around 5.

D. 110° C. Procedure

HCl (1.00 mol, 36%, 100 mL) was added dropwise to 3-dimethyl amino-1-propanol (DMAP, CAS 3179-63-3) (1.00 mol, 103 g) over 0.5 h with the temperature maintained between 10-20° C. The resultant solution was cooled to 5° C. Epichlorohydrin (EPI, CAS 106-89-8) (1.2 mol, 111 g) was added dropwise over 1 h. The reaction mixture was stirred for 2 h, warming to 20° C. as a consequence of the ice melting. The mixture was heated to 60° C. and stirred for 2 h under reflux. The condenser was then removed and reaction was stirred for an additional 1 h at 110° C. The product was weighed, and water was added as needed to obtain a 50% w/w solution. The final pH of the mixture containing the ring-open product 3-chloro-2-hydroxy-N-(3-hydroxypropyl)-N,N-dimethylpropan-1-aminium chloride (CHPDMAP) was around 5.

Figure 2:
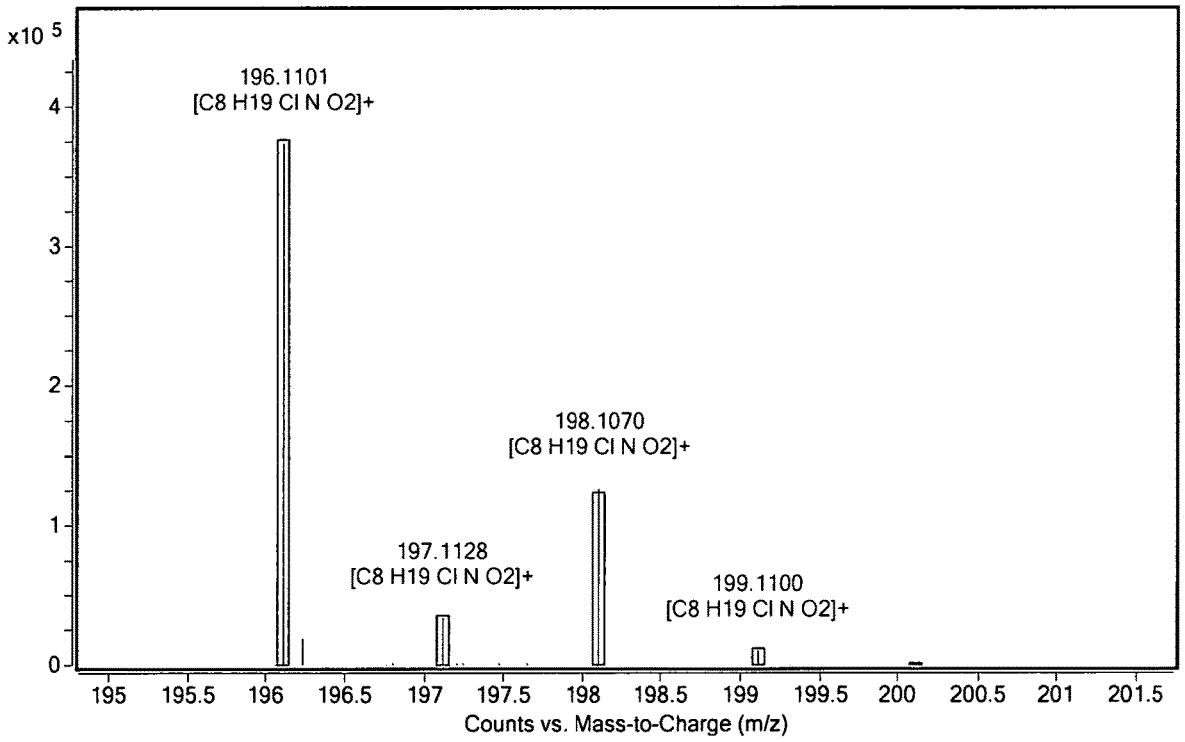
FIG. 2 is a plot showing a positive ion ESI MS spectrum for molecular ion region of glycidoxyDMAP.
Figure 3:
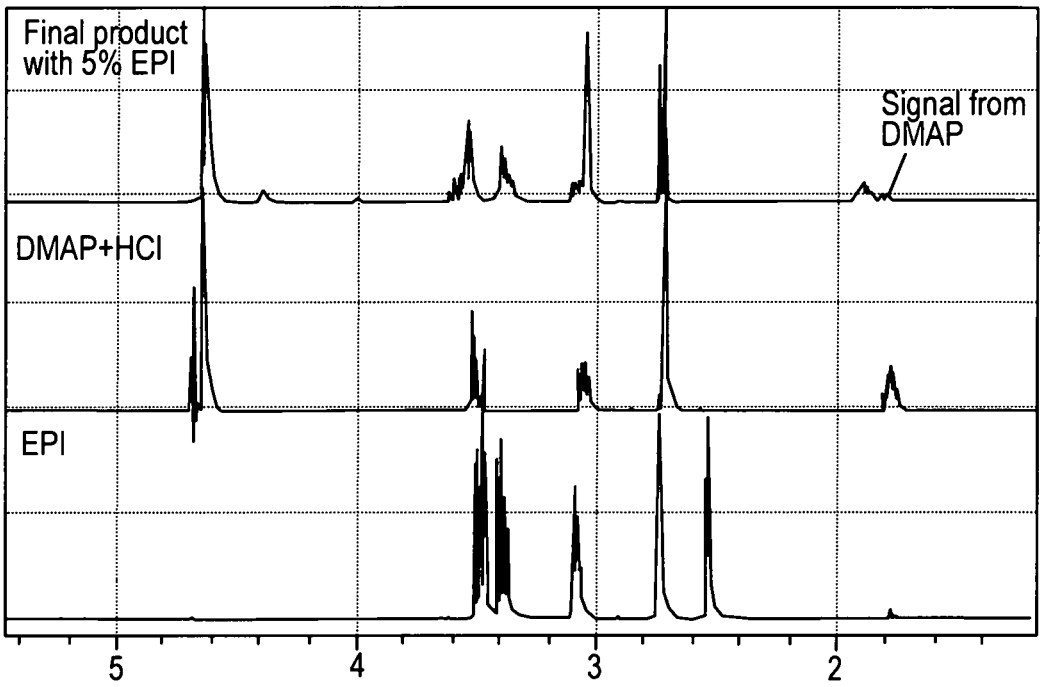
FIG. 3 is a plot showing $^1$H Nuclear Magnetic Resonance (NMR) spectra of product obtained with 5% epihalohydrin (EPI), DMAP+HCl, and EPI.
Figure 4:
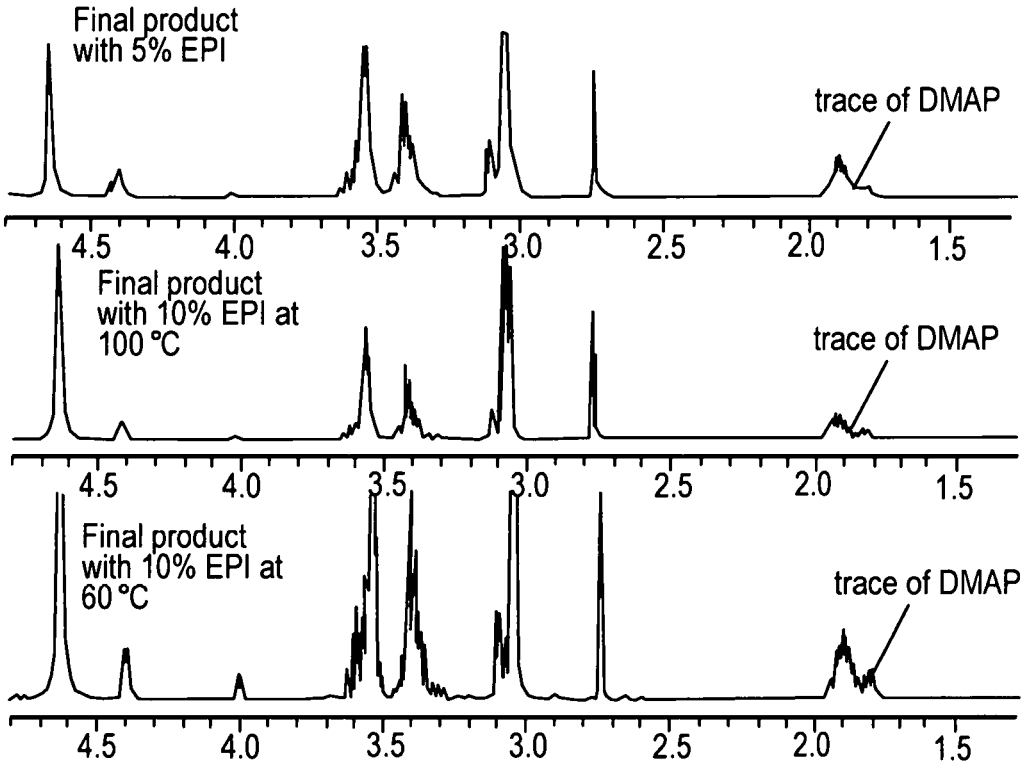
FIG. 4 is a plot showing $^1$H NMR spectra of product obtained with 5% EPI, product obtained with 10% EPI at 100° C., and product obtained with 10% EPI at 60° C.
Figure 5:
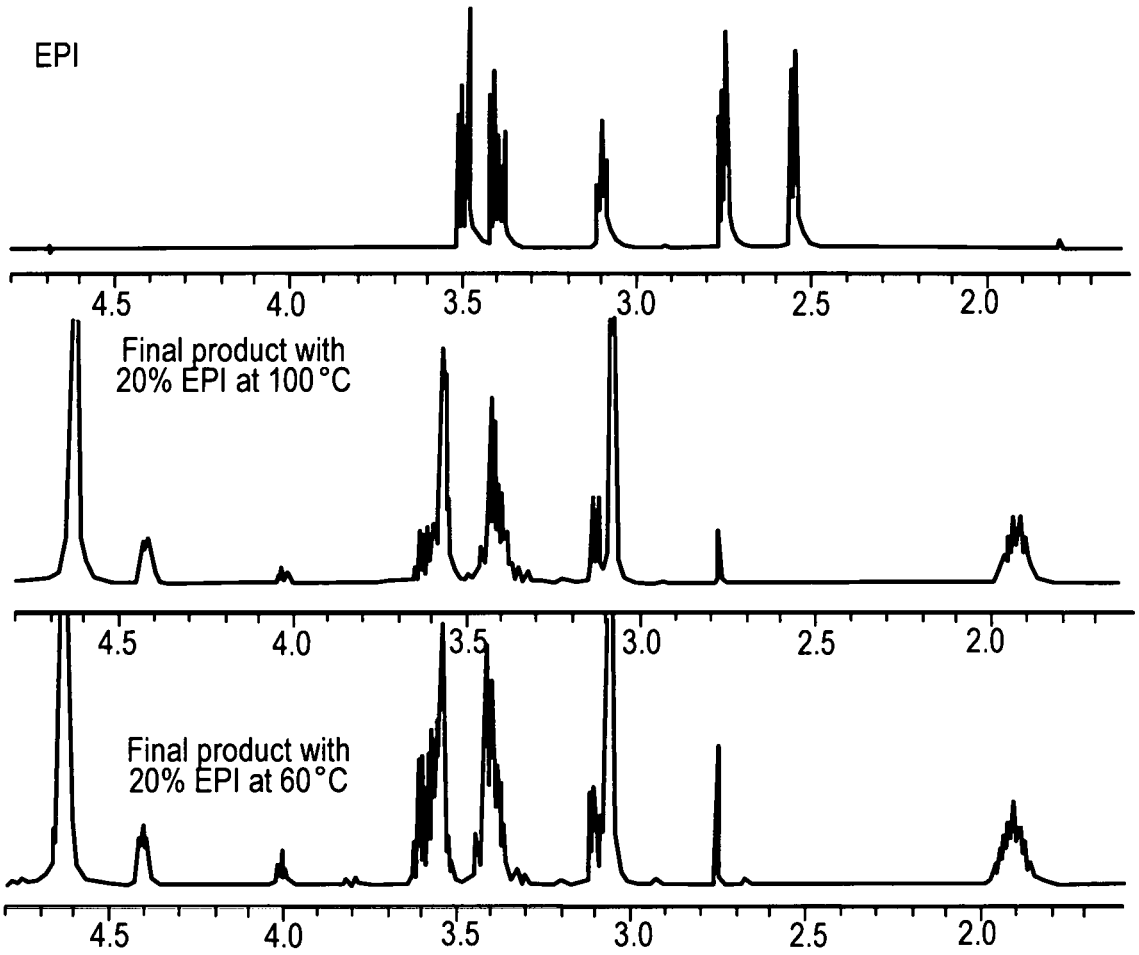
FIG. 5 is a plot showing $^1$H NMR spectra of EPI, product obtained with 20% EPI at 100° C., and product obtained with 20% EPI at 60° C.

FIG. 1 shows a positive ion ESI MS spectrum of glycidoxyDMAP. FIG. 2 shows a positive ion ESI MS spectrum for the molecular ion region of glycidoxyDMAP. HR-MS analysis (FIGS. 1 and 2) confirmed that the reaction product is in the form of the epoxide. The expected molecular ion peaks were obtained for the $Cl^{35}/Cl^{37}$ isotopes (cf. m/z 196/198; FIG. 2). FIG. 3 shows $^{1}H$ NMR spectra of 1) product obtained with 5% EPI (top spectrum); 2) DMAP+ HCl (middle spectrum) and 3) EPI (bottom spectrum). FIG. 4 shows $^{1}H$ NMR spectra of 1) product obtained with 5% EPI (top spectrum); 2) product obtained with 10% EPI at 100° C. (middle spectrum) and 3) product obtained with 10% EPI at 60° C. (bottom spectrum). FIG. 5 shows $^{1}H$ NMR spectra of 1) EPI (top spectrum); 2) product obtained with 20% EPI at 100° C. (middle spectrum) and 3) product obtained with 20% EPI at 60° C. (bottom spectrum).

Example 2—Dyeing Cotton with the Aid of CHPDMAP

Cotton fabric samples were dyed in two steps: 1) pad batch treatment with an aqueous solution of CHPDMAP in the presence of sodium hydroxide (2:1 NaOH:CHPDMAP) at room temperature for 24 h to give cationized cotton fabric that was washed to remove unreacted CHPDMAP; and 2) application of an anionic dye to obtain dyed cotton fabric. Additionally, the same fabric was padded with CHPDMAP and cured for two minutes at 170° C. and subsequently washed and dried with the same methodology as the pad batch samples. For comparison, cotton fabric samples were dyed without CHPDMAP treatment and after treatment with an aqueous solution of CHPTAC in the presence of sodium hydroxide (2:1 NaOH:CHPTAC).

Figure 6:
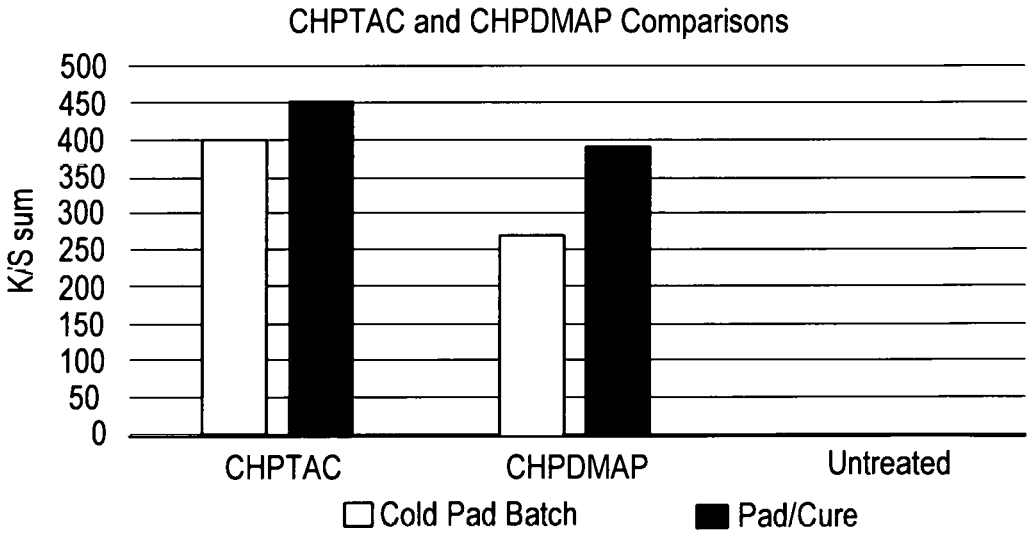
FIG. 6 is a bar graph showing the color intensity of cotton fabric samples obtained after dyeing with the aid of a 2:1 mixture of NaOH and 3-chloro-2-hydroxy-N-(3-hydroxypropyl)-N,N-dimethylpropan-1-aminium chloride (CHPDMAP); dyeing with the aid of a 2:1 mixture of NaOH and (3-chloro-2-hydroxypropyl)trimethylammonium chloride (CHPTAC); and dyeing without prior cationization.

FIG. 6 is a bar graph showing the K/S sum obtained after dyeing with the aid of a 2:1 mixture of NaOH:CHPTAC (cold pad batch (left) and pad/cure (right)), dyeing with the aid of a 2:1 mixture of NaOH:CHPDMAP (cold pad batch (left) and pad/cure (right)), and dyeing without prior cationization (cold pad batch (left) and pad/cure (right)). As used herein, "K/S sum" indicates the color strength (color intensity) of the dyed cotton fabric, where K represents an absorption characteristic and S represents scattering. K/S was measured using an X-Rite spectrophotometer with color iControl software, and the K/S sum was calculated by summation of the K/S values at 10 nm intervals in the wavelength range 360-750 nm. For the cold pad batch samples, the color intensity of the CHPDMAP sample was about 70% of the color intensity of the CHPTAC sample. For the pad/cure samples, the color intensity of the CHPDMAP sample was about 90% of the color intensity of the CHPTAC sample. The color intensity of the CHPTAC and CHPDMAP treated samples was significantly greater than that of the untreated samples.

Other Embodiments

While the present application has been described in conjunction with the detailed description thereof, the foregoing description is intended to illustrate and not limit the scope of the present application. Other aspects, advantages, and modifications are within the scope of the following claims.

What is claimed is:

1. A method of functionalizing a fibrous material comprising a plurality of hydroxyl groups, the method comprising:

reacting the fibrous material with a compound of Formula I:

(I)

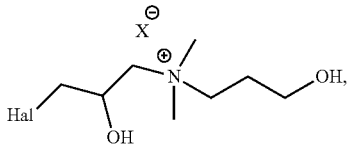

wherein X is a monovalent counteranion for the quaternary ammonium cation of Formula I and Hal is a halogen atom, to obtain the functionalized fibrous material.

2. The method of claim 1, wherein Hal is selected from Cl and Br.

3. The method of claim 1, wherein Xis selected from Cl and Br.

4. The method of claim 1, wherein the fibrous material comprises cellulosic fibrous material.

5. The method of claim 4, wherein the cellulosic fibrous material is a natural fibrous material.

6. The method of claim 5, wherein the natural fibrous material comprises cotton.

7. The method of claim 4, wherein the cellulosic fibrous material is a synthetic fibrous material.

8. The method of claim 7, wherein the synthetic fibrous material comprises rayon.

9. The method of claim 1, wherein the reacting is carried out in an aqueous solvent.

10. The method of claim 1, wherein the reacting comprises forming a covalent bond between the carbon atom to which Hal is attached and the oxygen atom of a hydroxyl group of the fibrous material.

11. The method of claim 1, wherein the functionalized fibrous material comprises at least one moiety of formula:

(II)

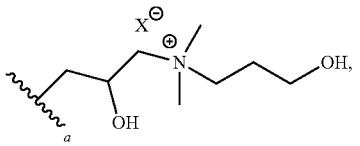

wherein a denotes a point of attachment of the moiety of Formula II to an oxygen atom of a hydroxyl group of the fibrous material.

12. The method of claim 1, wherein the reacting is carried out in the presence of a base.

13. The method of claim 12 wherein a molar ratio of the base to the compound of Formula I is from about 1:1 to about 2:1.

14. The method of claim 13, wherein the base is an alkali hydroxide.

15. The method of claim 1, wherein the reacting is carried out at about room temperature.

16. A functionalized fibrous material prepared by the method of claim 1.

17. A fibrous material comprising a plurality of hydroxyl groups, wherein at least one hydroxyl group of the fibrous material is functionalized with a moiety of Formula II:

(II)

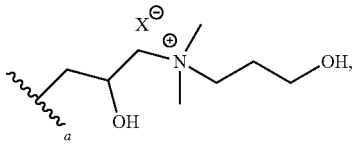

wherein X is a monovalent counteranion for the quaternary ammonium cation of Formula II, and a denotes a point of attachment of the moiety of Formula II to the oxygen atom of the hydroxyl group of the fibrous material.

18. The fibrous material of claim 17, having an odor below the threshold of detection.

19. The fibrous material of claim 17, having an odor with a degree of offensiveness of about 3 or less.

20. A method of dyeing the fibrous material of claim 17, the method comprising contacting the fibrous material with a dye.

* * * * *